US006005491A

United States Patent [19]

Kopchak et al.

[11] Patent Number: 6,005,491

[45] Date of Patent: Dec. 21, 1999

[54] MOTION DETECTING TRAFFIC LIGHT

[76] Inventors: James Kopchak, 1836 S. Easton Rd., Doylestown, Pa. 18901; Glenn Le Gault, 2074 Sturbridge Dr., Jamison, Pa. 18929

[21] Appl. No.: 09/226,261

[22] Filed: Jan. 7, 1999

[51] Int. Cl.[6] ..... G08G 1/095

[52] U.S. Cl. ..... 340/907; 340/907; 340/919; 340/917; 340/902; 340/903

[58] Field of Search ..... 340/436, 907, 340/919, 917, 902, 903

[56] References Cited

U.S. PATENT DOCUMENTS

| | | | |
|---|---|---|---|
| 1,665,592 | 4/1928 | Kennedy | 340/907 |
| 2,173,747 | 9/1939 | Adler, Jr. | 340/907 |
| 3,196,386 | 7/1965 | Rosssi et al. | 340/907 |
| 4,843,337 | 6/1989 | Conn, Jr. et al. | 340/906 |
| 5,128,670 | 7/1992 | Jackson et al. | 340/907 |
| 5,448,219 | 9/1995 | Yoshikawa et al. | 340/436 |
| 5,497,148 | 3/1996 | Oliva | 340/905 |
| 5,917,432 | 6/1999 | Rathbone | 340/907 |
| 5,940,010 | 8/1999 | Sasaki et al. | 340/901 |

*Primary Examiner*—Jeffery A. Hofsass
*Assistant Examiner*—Tai T. Nguyen

[57] ABSTRACT

A motion detecting traffic light system is provided for use at a blind corner adjacent to which a first roadway and a second roadway intersect. Included is a motion sensor positioned on the first roadway and adapted to transmit an activation signal upon the detection of motion of a vehicle on the first roadway. Also provided is an indicator assembly positioned on the second roadway and adapted to provide an indication to a vehicle on the second roadway upon the receipt of the activation signal.

6 Claims, 2 Drawing Sheets

MOTION DETECTING TRAFFIC LIGHT

BACKGROUND OF THE INVENTION

1. Field of the Invention

The present invention relates to traffic lights and more particularly pertains to a new motion detecting traffic light for preventing collisions around blind corners.

2. Description of the Prior Art

The use of traffic lights is known in the prior art. More specifically, traffic lights heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,572,202; 4,843,337; 4,115,757; 3,247,482; 2,903,674; and U.S. Pat. No. Des. 385,811.

In these respects, the motion detecting traffic light according to the present invention substantially departs from the conventional concepts and designs of the prior art, and in so doing provides an apparatus primarily developed for the purpose of preventing collisions around blind corners.

SUMMARY OF THE INVENTION

In view of the foregoing disadvantages inherent in the known types of traffic lights now present in the prior art, the present invention provides a new motion detecting traffic light construction wherein the same can be utilized for preventing collisions around blind corners.

The general purpose of the present invention, which will be described subsequently in greater detail, is to provide a new motion detecting traffic light apparatus and method which has many of the advantages of the traffic lights mentioned heretofore and many novel features that result in a new motion detecting traffic light which is not anticipated, rendered obvious, suggested, or even implied by any of the prior art traffic lights, either alone or in any combination thereof.

To attain this, the present invention is adapted for use with an obstruction with a height greater than that of a vehicle. Such obstruction, which may take the form of a building or the like. Such building has a pair of adjacent substantially planar surfaces in perpendicular relationship. As shown in FIG. 1, a first roadway is positioned adjacent to a first one of the surfaces of the obstruction in parallel therewith. Associated therewith is a second roadway positioned adjacent to a second one of the surfaces of the obstruction in parallel with the second surface. Such second roadway remains in perpendicular relationship with the first roadway to define a corner. The present invention includes a pair of brackets each having a substantially planar rectangular base plate with corners having apertures formed therein. A substantially linear rod is coupled to a central extent of the base plate and extends therefrom in perpendicular relationship therewith. For supporting the rod, a substantially planar triangular support is coupled between an inboard extent of the rod and the base plate. The brackets include a first bracket having the base plate thereof coupled to the first surface of the obstruction. As such, the rod extends from the base plate in perpendicular relationship therewith adjacent to the corner. The brackets further include a second bracket having the base plate thereof coupled to the second surface of the obstruction. As such, the rod extends from the obstruction in perpendicular relationship therewith adjacent to the corner. Also included is a motion sensor having a substantially cylindrical configuration with a side wall pivotally coupled to a lower side of a central extent of the rod of the first bracket. This coupling is preferably accomplished by way of a universal joint. It should be noted that the motion sensor has a motion sensor wire connected thereto and extending within the rod of the first bracket and through a bore formed in the base plate of the first bracket. In use, the motion sensor is adapted to transmit an activation signal via the motion sensor wire upon the detection of motion on the first roadway. Next provided is an indicator assembly including a substantially planar rectangular sign having a top edge coupled to a lower side of the rod of the second bracket and depending downwardly therefrom in coplanar relationship therewith. A substantially semi-cylindrical light assembly is mounted on a face of the sign adjacent to a bottom edge thereof. Similar to the motion sensor, the light assembly has a light wire connected thereto. In operation, the light assembly serves to intermittently illuminate upon the receipt of the activation signal via the light assembly wire. Finally, a control box is connected between the motion sensor wire and the light assembly wire for powering the indicator assembly and the motion sensor. The control box is further adapted for passing the activation signal to the light assembly wire upon the receipt thereof via the motion sensor wire for providing an indication to a vehicle on the second roadway that a vehicle is approaching on the first roadway.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new motion detecting traffic light apparatus and method which has many of the advantages of the traffic lights mentioned heretofore and many novel features that result in a new motion detecting traffic light which is not anticipated, rendered obvious, suggested, or even implied by any of the prior art traffic lights, either alone or in any combination thereof.

It is another object of the present invention to provide a new motion detecting traffic light which may be easily and efficiently manufactured and marketed.

It is a further object of the present invention to provide a new motion detecting traffic light which is of a durable and reliable construction.

An even further object of the present invention is to provide a new motion detecting traffic light which is susceptible of a low cost of manufacture with regard to both materials and labor, and which accordingly is then susceptible of low prices of sale to the consuming public, thereby making such motion detecting traffic light economically available to the buying public.

Still yet another object of the present invention is to provide a new motion detecting traffic light which provides in the apparatuses and methods of the prior art some of the advantages thereof, while simultaneously overcoming some of the disadvantages normally associated therewith.

Still another object of the present invention is to provide a new motion detecting traffic light for preventing collisions around blind corners.

Even still another object of the present invention is to provide a new motion detecting traffic light that is adapted for use at a blind corner adjacent to which a first roadway and a second roadway intersect. Included is a motion sensor positioned on the first roadway and adapted to transmit an activation signal upon the detection of motion of a vehicle on the first roadway. Also provided is an indicator assembly positioned on the second roadway and adapted to provide an indication to a vehicle on the second roadway upon the receipt of the activation signal.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
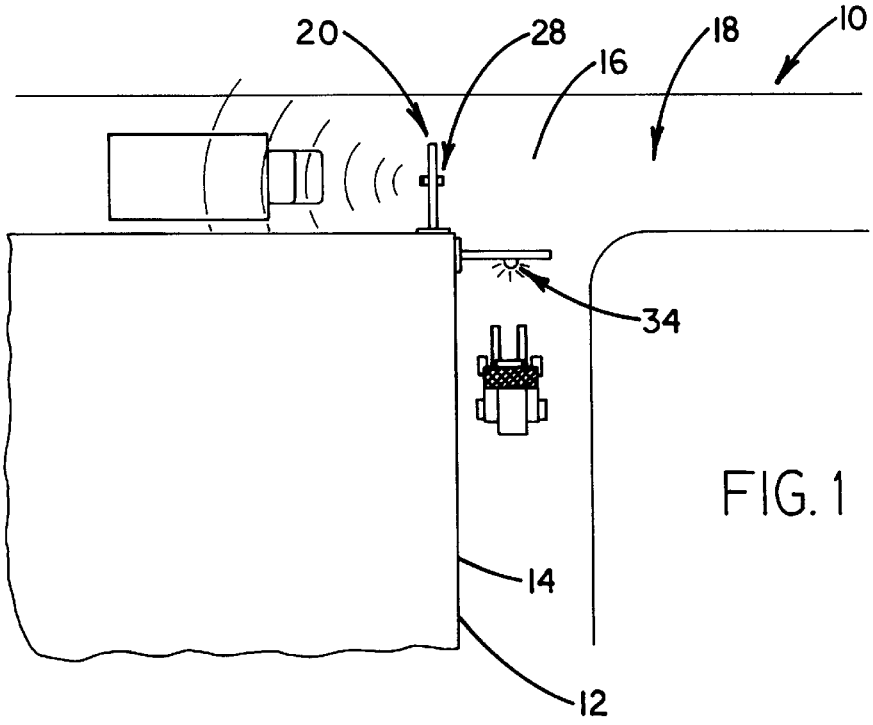
FIG. 1 is a top plan view of a new motion detecting traffic light according to the present invention.
Figure 2:
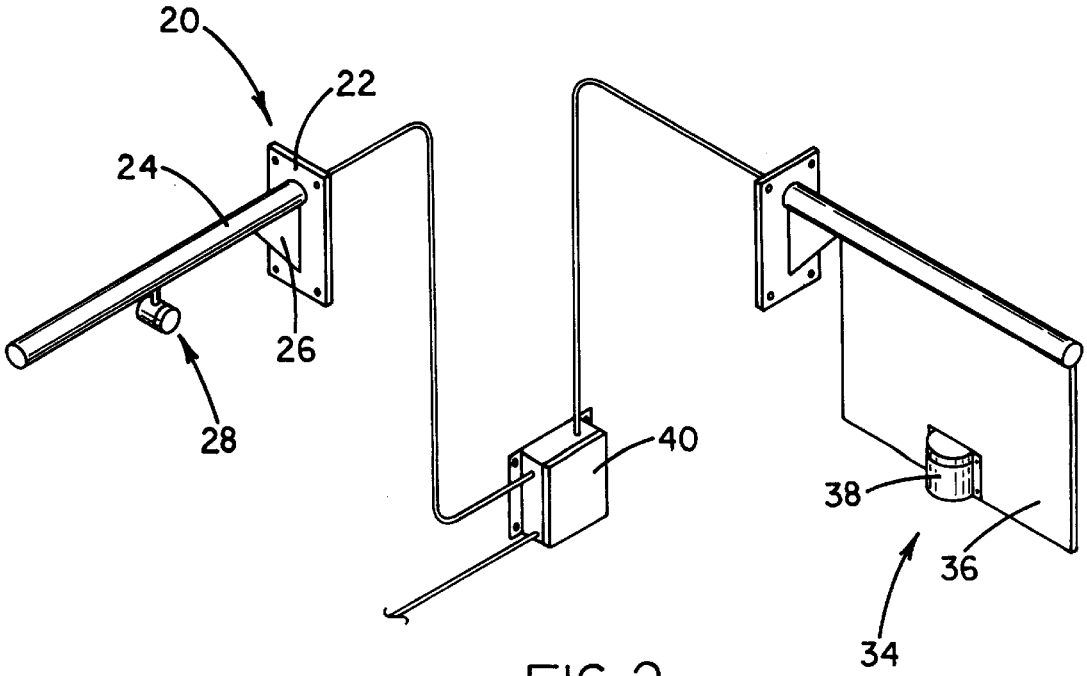
FIG. 2 is an exploded perspective view of the present invention.
Figure 4:
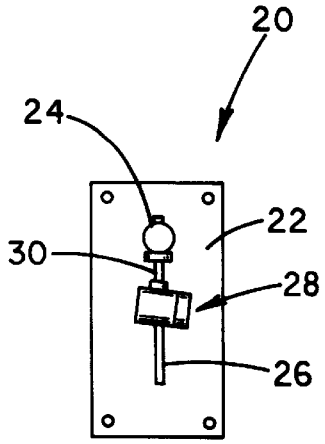
FIG. 4 is an end view of the motion sensor of the present invention as shown in FIG. 3.
Figure 3:
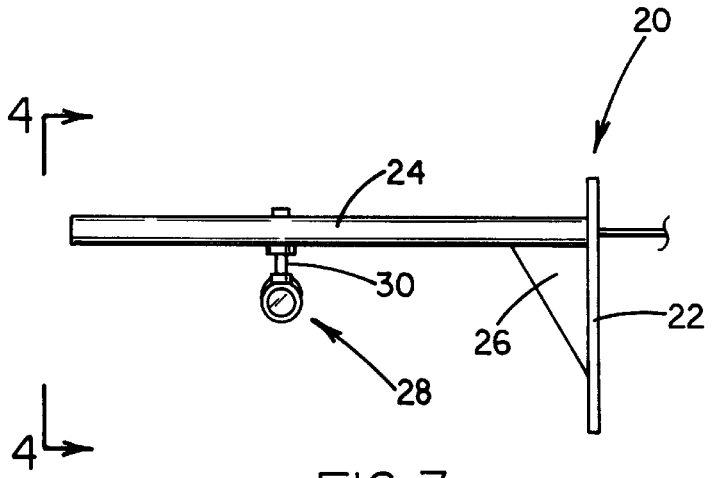
FIG. 3 is a side view of the motion sensor of the present invention with the associated bracket.
Figure 5:
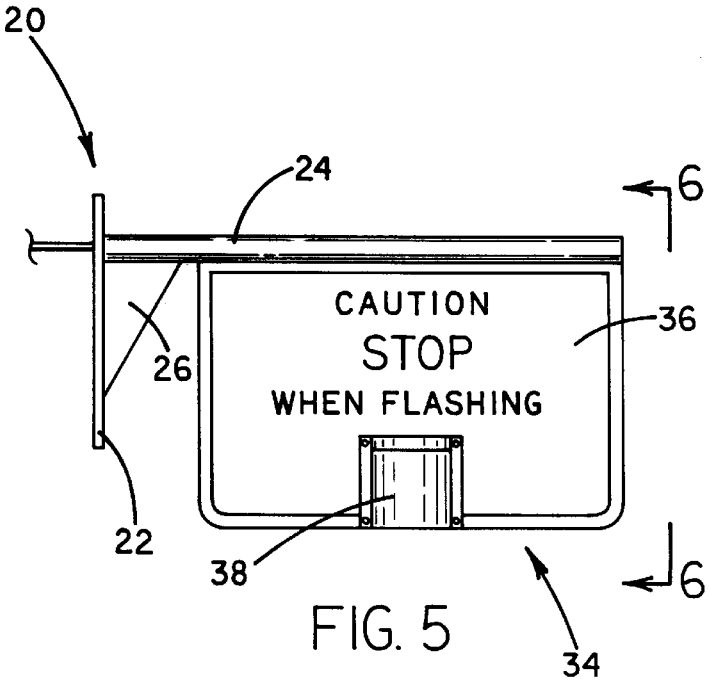
FIG. 5 is a side view of the indicator assembly of the present invention showing the sign and light assembly thereof.
Figure 6:
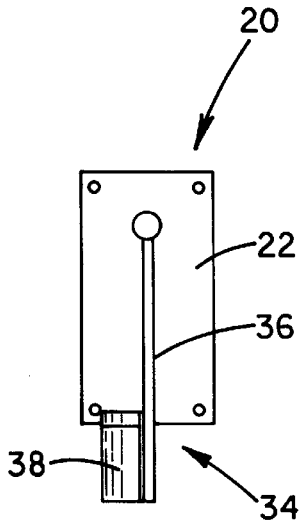
FIG. 6 is an end view of the indicator assembly of the present invention.

With reference now to the drawings, and in particular to FIGS. 1 through 6 thereof, a new motion detecting traffic light embodying the principles and concepts of the present invention and generally designated by the reference numeral 10 will be described.

As best illustrated in FIGS. 1 through 6, the present invention, designated as numeral 10, is adapted for use with an obstruction 12 with a height greater than that of a vehicle. Such obstruction, which may take the form of a building or the like. Such building has a pair of adjacent substantially planar surfaces 14 in perpendicular relationship. As shown in FIG. 1, a first roadway 16 is positioned adjacent to a first one of the surfaces of the obstruction in parallel therewith. Associated therewith is a second roadway 16 positioned adjacent to a second one of the surfaces of the obstruction in parallel with the second surface. Such second roadway remains in perpendicular relationship with the first roadway to define a corner 18.

The present invention includes a pair of brackets 20 each having a substantially planar rectangular base plate 22 with corners having apertures formed therein. A substantially linear rod 24 is coupled to a central extent of the base plate and extends therefrom in perpendicular relationship therewith. For supporting the rod, a substantially planar triangular support 26 is coupled between an inboard extent of the rod and the base plate. The brackets include a first bracket having the base plate thereof coupled to the first surface of the obstruction. As such, the rod of the first bracket extends from the base plate in perpendicular relationship therewith adjacent to the corner. The brackets further include a second bracket having the base plate thereof coupled to the second surface of the obstruction. As such, the rod of the second bracket extends from the obstruction in perpendicular relationship therewith adjacent to the corner. Both of the brackets are preferably spaced from the corner such that the brackets and attachments thereon are not visible from a vehicle traveling on the other roadway.

Also included is a motion sensor 28 having a substantially cylindrical configuration with a side wall pivotally coupled to a lower side of a central extent of the rod of the first bracket. This coupling is preferably accomplished by way of a universal joint 30 to allow pivoting about a vertical and horizontal axis. It should be noted that the motion sensor has a motion sensor wire connected thereto and extending within the rod of the first bracket and through a bore formed in the base plate of the first bracket. In use, the motion sensor is adapted to transmit an activation signal via the motion sensor wire only during the detection of motion on the first roadway. Ideally, the motion sensor is directed away from the corner such that an area in which motion is being detected includes a portion of the first roadway ahead of the corner.

Next provided is an indicator assembly 34 including a substantially planar rectangular sign 36 having a top edge coupled to a lower side of the rod of the second bracket and depending downwardly therefrom in coplanar relationship therewith. A substantially semi-cylindrical light assembly 38 is mounted on a face of the sign adjacent to a bottom edge thereof. The light assembly preferably resides on a side of the sign which faces away from the corner. Similar to the motion sensor, the light assembly has a light wire connected thereto. In operation, the light assembly serves to intermittently illuminate upon the receipt of the activation signal via the light assembly wire.

In the preferred embodiment, warning indicia is situated on the sign which is illuminated upon the illumination of the light assembly. Further, a pair of lights are preferably positioned within the light assembly including a yellow light and a red light. In a first mode of operation during the lack of receipt of the activation signal, the yellow light is continuously illuminated to illuminate the sign and the red light deactuated. In a second mode of operation during the receipt of the activation signal, the red light is intermittently illuminated to illuminate the sign and the yellow light deactuated.

Finally, a control box 40 is connected between the motion sensor wire and the light assembly wire for powering the indicator assembly and the motion sensor. The control box is further adapted for passing the activation signal to the light assembly wire upon the receipt thereof via the motion sensor wire for providing an indication to a vehicle on the second roadway that a vehicle is approaching on the first roadway. For mounting purposes, the control box may include a pair of outwardly extending apertured rectangular lips extending from a rear face thereof in coplanar relationship therewith. Note FIG. 2.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A motion detecting traffic light system comprising, in combination:

an obstruction with a height greater than that of a vehicle and having a pair of adjacent substantially planar surfaces in perpendicular relationship, wherein a first roadway is positioned adjacent to a first one of the surfaces of the obstruction in parallel therewith and a second roadway is positioned adjacent to a second one of the surfaces of the obstruction in parallel with the second surface and in perpendicular relationship with the first roadway to define a corner;

a pair of brackets each having a substantially planar rectangular base plate with corners having apertures formed therein, a substantially linear rod coupled to a central extent of the base plate and extending therefrom in perpendicular relationship therewith, and a substantially planar triangular support coupled between an inboard extent of the rod and the base plate for supporting the rod, wherein the brackets include a first bracket having the base plate thereof coupled to the first surface of the obstruction such that the rod extends therefrom in perpendicular relationship therewith adjacent to the corner, wherein the brackets further include a second bracket having the base plate thereof coupled to the second surface of the obstruction such that the rod extends therefrom in perpendicular relationship therewith adjacent to the corner;

a motion sensor having a substantially cylindrical configuration with a side wall pivotally coupled to a lower side of a central extent of the rod of the first bracket via a universal joint and depending therefrom, the motion sensor having a motion sensor wire connected thereto and extending within the rod of the first bracket and through a bore formed in the base plate of the first bracket, wherein the motion sensor is adapted to transmit an activation signal via the motion sensor wire upon the detection of motion on the first roadway;

an indicator assembly including a substantially planar rectangular sign having a top edge coupled to a lower side of the rod of the second bracket and depending downwardly therefrom in coplanar relationship therewith and a substantially semi-cylindrical light assembly mounted on a face of the sign adjacent to a bottom edge thereof, the light assembly having a light wire connected thereto and extending within the rod of the second bracket and through a bore formed in the base plate of the second bracket, wherein the light assembly is adapted to intermittently illuminate upon the receipt of the activation signal via the light assembly wire; and a control box connected between the motion sensor wire and the light assembly wire for powering the indicator assembly and the motion sensor and further passing the activation signal to the light assembly wire upon the receipt thereof via the motion sensor wire for providing an indication to a vehicle on the second roadway that a vehicle is approaching on the first roadway.

2. A motion detecting traffic light system adapted for use at a blind corner adjacent to which a first roadway and a second roadway intersect, the system comprising:

an obstruction with a height greater than that of a vehicle, said obstruction having a pair of adjacent surfaces in an approximately adjacent relationship, a first surface of said obstruction being parallel and adjacent to said first roadway, a second surface of said obstruction being parallel and adjacent to said second roadway;

a motion sensor positioned on the first roadway that is adapted to transmit an activation signal upon the detection of motion of a vehicle on the first roadway; and an indicator assembly positioned on the second roadway that is adapted to provide an indication to a vehicle on the second roadway upon the receipt of the activation signal.

3. A motion detecting traffic light system as set forth in claim 2 wherein the indicator assembly includes a sign with warning indicia and a light adapted to illuminate upon the receipt of the activation signal.

4. A motion detecting traffic light system as set forth in claim 3 wherein the light is adapted to illuminate intermittently upon the receipt of the activation signal.

5. A motion detecting traffic light system as set forth in claim 2 wherein the motion sensor is pivotally adjustable.

6. A motion detecting traffic light system comprising:

an intersection of a first path and a second path;

an obstruction with a height greater than that of a vehicle, said obstruction having a first side and a second side, whereby said sides having an adjacent edge, said edge defining an angle substantially equal to an angle defined by said intersection of said first path and said second path, said first side being adjacent and parallel to said first path, said second side being adjacent and parallel to said second path;

a motion sensor mounted to said first surface, said motion sensor positioned to detect motion of a vehicle on said first roadway, said motion sensor adapted to transmit an activation signal; and an indicator assembly operationally coupled to said motion sensor whereby said indicator assembly is mounted to said second surface wherein said indicator assembly provides an indication to a vehicle on the second roadway upon receipt of said activation signal.

* * * * *